US007399377B2

(12) United States Patent
Crane et al.

(10) Patent No.: US 7,399,377 B2
(45) Date of Patent: Jul. 15, 2008

(54) PROCESS FOR SINGULATING CELLULOSE FIBERS FROM A WET PULP SHEET

(75) Inventors: Ray Crane, Columbus, MS (US); Nordahl K. Johnson, Puyallup, WA (US)

(73) Assignee: Weyerhaeuser Co., Federal Way, WA (US)

( * ) Notice: Subject to any disclaimer, the term of this patent is extended or adjusted under 35 U.S.C. 154(b) by 556 days.

(21) Appl. No.: 10/336,366

(22) Filed: Jan. 2, 2003

(65) Prior Publication Data

US 2004/0129392 A1 Jul. 8, 2004

(51) Int. Cl.
*D21B 1/04* (2006.01)
*D21B 1/38* (2006.01)

(52) U.S. Cl. ..... 162/20; 162/28; 162/55; 241/21; 241/28; 241/24.29

(58) Field of Classification Search ..... 162/24–26, 162/28, 20, 9, 157.6; 241/28, 57, 189.1, 241/21, 24.1, 24.29; 34/356
See application file for complete search history.

(56) References Cited

U.S. PATENT DOCUMENTS

| | | | | |
|---|---|---|---|---|
| 2,609,995 | A * | 9/1952 | Klagsbrunn | 241/154 |
| 2,750,123 | A * | 6/1956 | Keiper | 241/25 |
| 3,824,652 | A | 7/1974 | Buell | |
| 3,961,397 | A | 6/1976 | Neuenschwander | |
| 3,966,126 | A * | 6/1976 | Werner | 241/18 |
| 4,241,881 | A | 12/1980 | Laumer | |
| 4,640,810 | A * | 2/1987 | Laursen et al. | 264/518 |
| 4,650,127 | A * | 3/1987 | Radwanski et al. | 241/48 |
| 5,253,815 | A * | 10/1993 | Bowns et al. | 241/186.1 |
| 5,324,391 | A * | 6/1994 | Carney et al. | 162/9 |
| 5,560,553 | A | 10/1996 | Crane | |
| 5,779,857 | A * | 7/1998 | Norlander | 162/157.6 |
| 6,296,737 | B1 * | 10/2001 | Wu et al. | 162/164.1 |
| 6,860,440 | B2 * | 3/2005 | Crane et al. | 241/57 |
| 7,134,623 | B2 * | 11/2006 | Elliott | 241/188.1 |
| 2001/0042605 | A1 * | 11/2001 | Goulet et al. | 162/4 |
| 2004/0129392 | A1 * | 7/2004 | Crane et al. | 162/1 |
| 2004/0129393 | A1 * | 7/2004 | Crane et al. | 162/9 |
| 2004/0129808 | A1 * | 7/2004 | Crane et al. | 241/57 |

FOREIGN PATENT DOCUMENTS

| | | | |
|---|---|---|---|
| EP | 1435408 | A1 * | 7/2004 |
| EP | 1437441 | A2 * | 7/2004 |
| GB | 1 346 271 | | 2/1974 |
| GB | 1 449 667 | | 9/1976 |

* cited by examiner

*Primary Examiner*—José A Fortuna
(74) *Attorney, Agent, or Firm*—Christensen O'Connor Johnson Kindness

(57) ABSTRACT

A hammermill for singulating cellulosic fibers from a wet pulp sheet includes a cylindrical housing, a feed slot with a breaker bar positioned therein and a rotor mounted for rotation in the housing. Feed rolls are provided to feed a sheet of pulp into the feed slot upstream of the breaker bar. A plurality of hammers are mounted on the rotor. Air is introduced into the hammermill housing tangentially downstream from the second feed slot. An air outlet is positioned tangentially on the housing downstream from the air inlet to allow air and singulated fibers to escape. A process for producing singulated fibers includes wetting a fiber sheet, milling the fibers in the hammermill, and drying the fibers. The singulated fibers have a low knot content.

11 Claims, 9 Drawing Sheets

PROCESS FOR SINGULATING CELLULOSE FIBERS FROM A WET PULP SHEET

FIELD OF THE INVENTION

The present invention relates to singulating cellulosic pulp fibers from a pulp sheet, and more particularly to a process for singulating cellulose fiber from a wet pulp sheet.

BACKGROUND OF THE INVENTION

Pulp produced from a variety of pulping processes is usually formed into a sheet on a Fourdrinier press. The pulp slurry is first placed on the Fourdrinier press and the liquid is drained therefrom. The wet pulp sheet passes through a press section and into a dryer to remove the excess water. This produces a dry pulp sheet that is conventionally rolled into large rolls for storage and transportation. When the pulp is ready for use, the pulp fibers must be separated from the sheet and, preferably, singulated into individual fibers. Prior to singulation, the pulp may be treated with a cross-linking chemical in aqueous solution. The solution is applied to the pulp sheet in a variety of conventional ways, but results in a chemically treated, wet pulp sheet having a consistency in the range of from 50% to 80%. Singulating chemically treated cellulose fibers having a 50% to 80% consistency is accomplished in a variety of ways. In the past, the pulp sheets have first been run through hammermills and the resulting product run through disk fluffers, pin mills, fans or other devices to further separate the pulp into individual or singulated fibers. The prior hammermills employed have resulted in poor singulation of the fibers, thus the need for additional processing. Additional processing requires the expenditure of additional capital, maintenance and energy costs, thus increasing expense of singulation. In addition, prior hammermills have been exceedingly noisy.

SUMMARY OF THE INVENTION

The present invention provides a process for singulating cellulose fibers from a wet pulp sheet. The process comprises the steps of feeding the pulp sheet to a hammermill; feeding an air stream to the hammermill at an air feed location downstream from the pulp feed location; milling the pulp sheet in the hammermill to produce singulated fibers; conveying the singulated fibers in an air stream from the hammermill at an outlet location oriented at an angle from said air feed location to an air fiber separator; and separating said singulated fibers from the air stream. In a preferred process the pulp sheet is fed to the hammermill at a sheet feed speed of from 7.6 to 91.5 meters per minute. The hammermill also has rotor tips, which are preferably operated at a tip speed of from 3658 to 6706 meters per minute. The singulated fibers are preferably conveyed from the hammermill to the air fiber separator by a fan. The fan and the associated conduits are sized to provide an air stream velocity of from 1829 to 3048 meters per minute.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
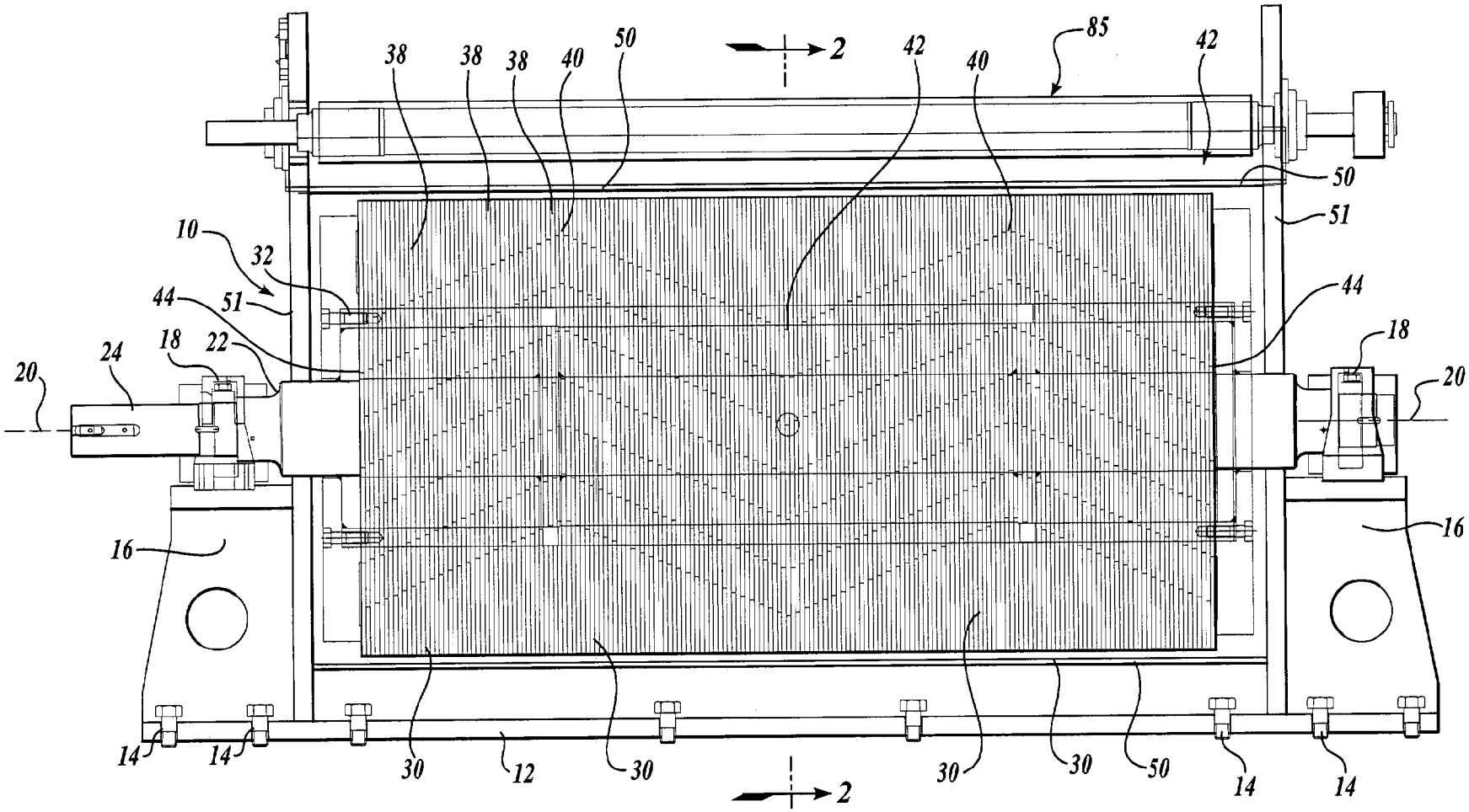
FIG. 1 is an elevation view of the hammermill of the present invention showing the rotor carrying a plurality of hammers and showing the rotor housing broken away, and taken along a view line similar to 1-1 of FIG. 2 with the breaker bar assembly omitted.
Figure 2:
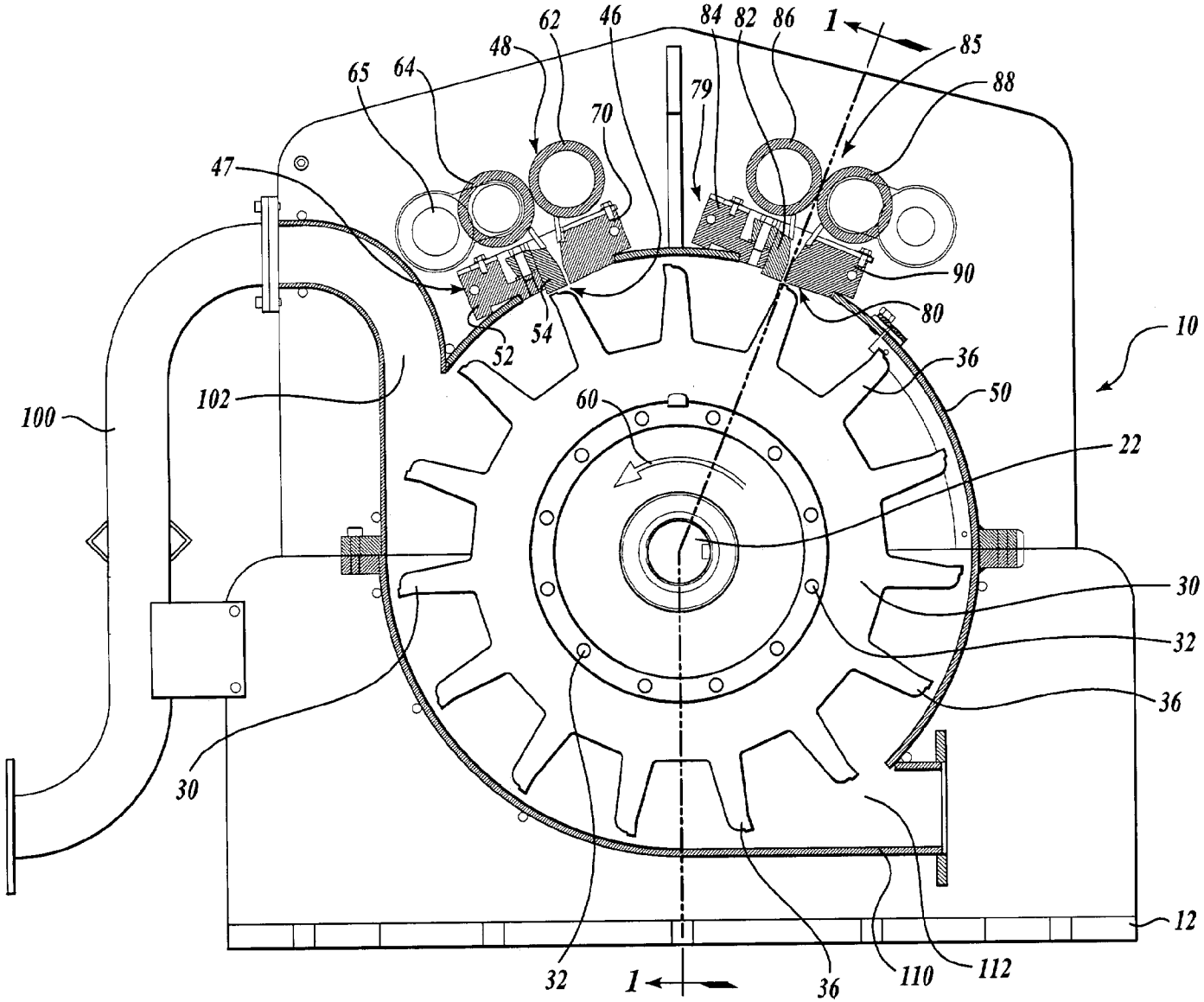
FIG. 2 is a cross-sectional view of the hammermill taken along the section line 2-2 of FIG. 1.

Referring to FIGS. 1 and 2, the hammermill generally designated 10 rests on a base 12. The base 12 may be fastened to a foundation floor or other object for securement by a plurality of fasteners 14. A pair of bearing stands 16 are spaced longitudinally apart on the base 12. A pair of bearings 18 are supported on the bearing stands 16 and are aligned along a longitudinal rotational axis generally designated 20. A rotor shaft 22 is mounted for rotation in the bearings 18. The rotor shaft 22 has an extension 24 on its one end onto which a drive coupling may be mounted.

A plurality of hammer segments 30 (represented by disks in FIG. 1) are mounted on the shaft 22. The hammer segments are affixed to the shaft and to each other by conventional means such as a plurality of bolts 32 extending through holes arranged circumferentially around the shaft 22. In this case, there are twelve bolts 32 arranged in a circular pattern. If desired, the hammers can be separated from adjacent hammers by spacers or can be positioned directly adjacent to each other. Other means of attaching the hammer to the shaft, such as keys or an octagon shaped rotor shaft may be employed.

In this embodiment, each hammer segment 30 has a plurality of hammer tips or blades 36 that extend radially outwardly from the hammermill shaft 22. (Only one hammer segment is shown in FIG. 2 for purposes of clarity.) In accordance with the present invention, each of the hammer segments 30 has from 12 to 24 blades, preferably 15 blades, that are equally spaced about the periphery of each of the segments 30. Each of these blades is circumferentially offset from the blades of the next adjacent hammer. The blades are offset so that the blades form a W or herringbone pattern when viewed from the side. This herringbone pattern is schematically illustrated by the offset dashes 38 in FIG. 1. In the preferred embodiment, the herringbone pattern is arranged such that two peaks 40 are provided as leading edges of the pattern in the direction of rotation of the rotor (arrow 60, FIG. 2). Offset in a direction opposite the direction of rotation are a central valley 42 and two edge valleys 44 adjacent the ends of the rotor. The peaks 40 are positioned inwardly from the ends of the rotor approximately one-fourth of the distance of the overall length, while the central valley 42 is positioned at the middle of the rotor. The offset herringbone W pattern minimizes the number of hammer tips striking the sheet at any one time reducing the noise. A variety of other patterns may be employed as desired.

Figure 3:
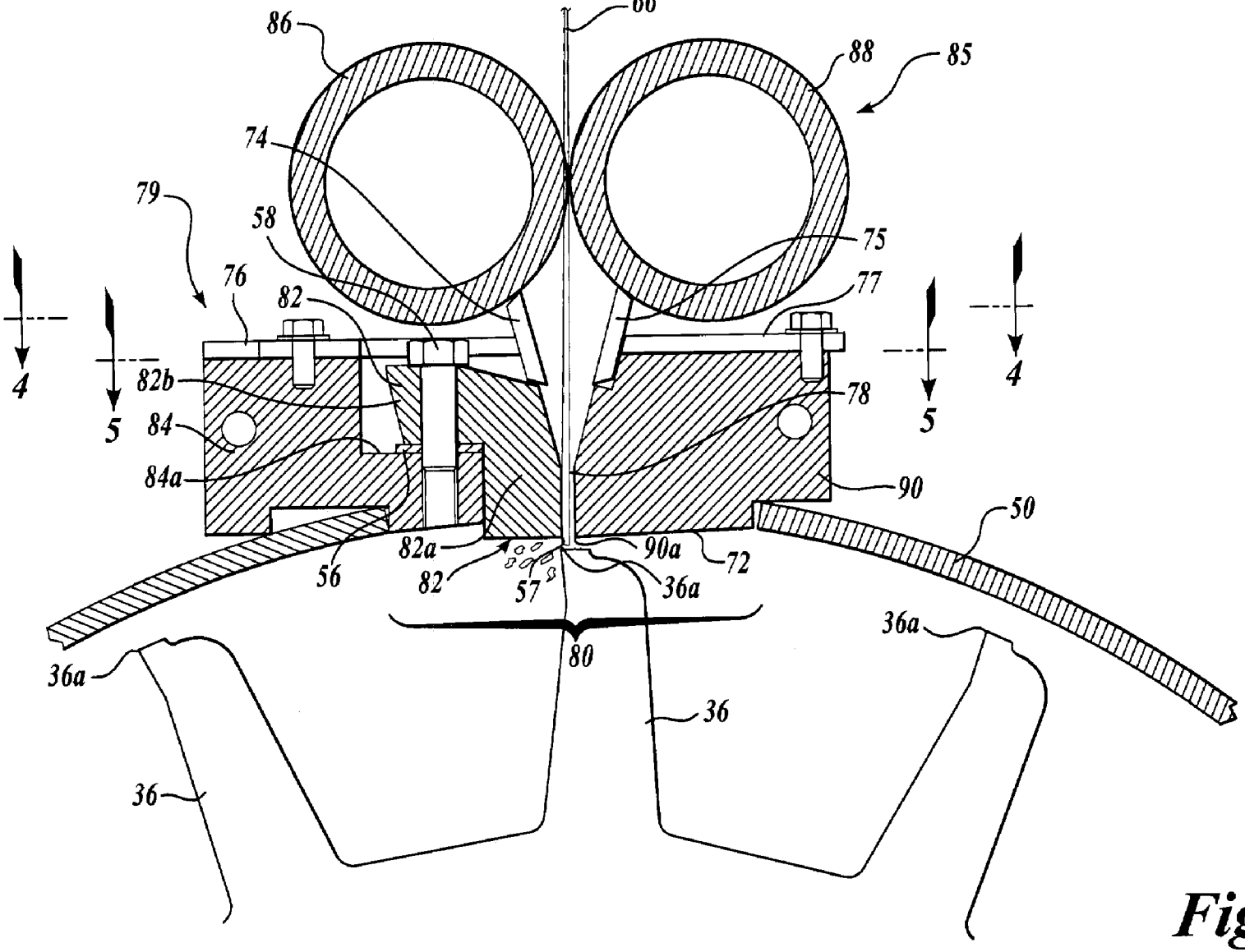
FIG. 3 is an enlarged sectional view of the breaker bar, mounting bars and feed rollers feeding a sheet of pulp into the hammermill of FIG. 2.
Figure 4:
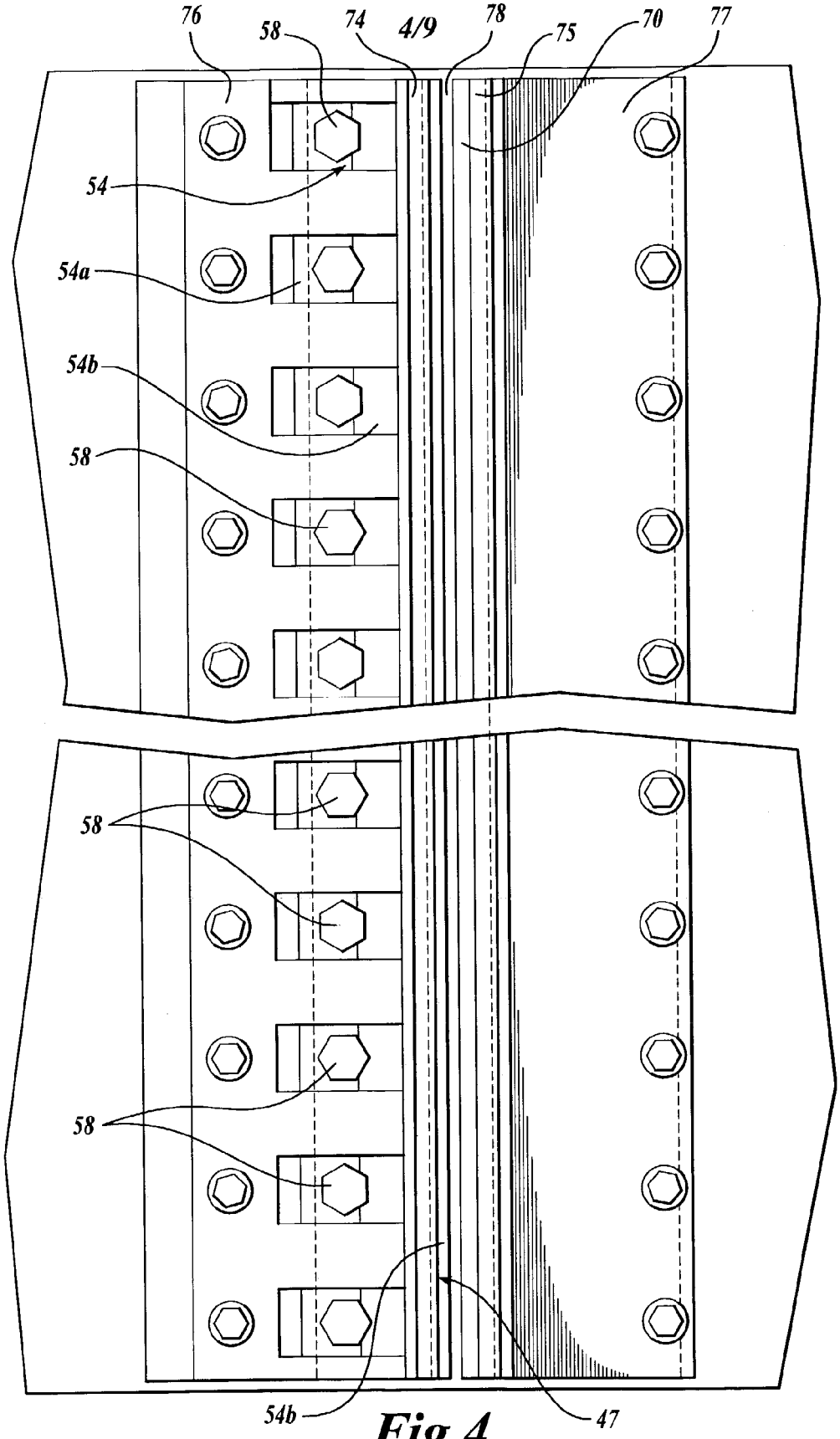
FIG. 4 is a sectional view taken along section line 4-4 of FIG. 3 showing the exterior of sheet guides, breaker bar, and the mounting means therefor.
Figure 5:
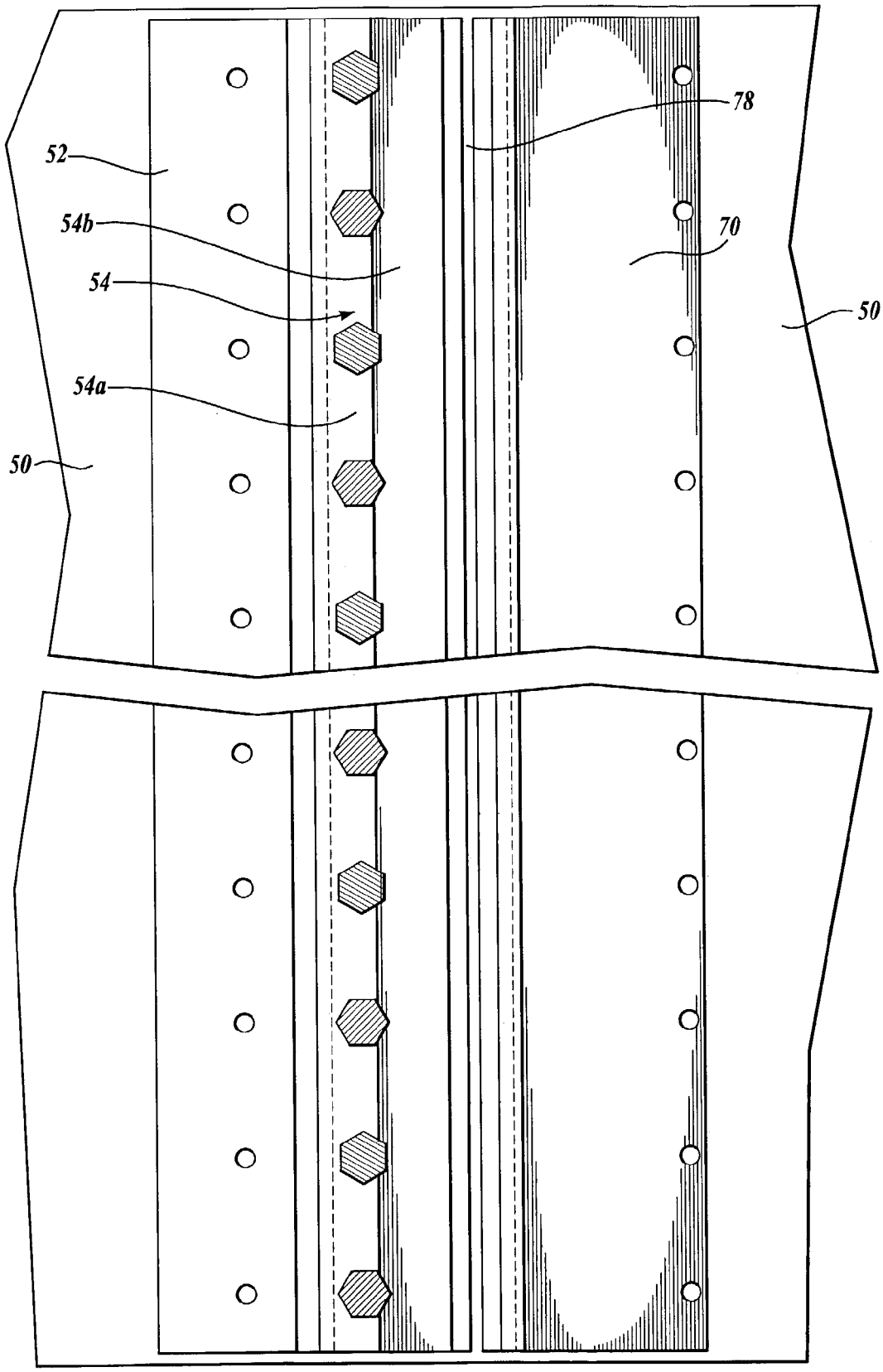
FIG. 5 is a sectional view similar to that of FIG. 4 taken along section line 5-5 of FIG. 3.

Referring to FIGS. 1 through 3, the rotor and hammer segments 30 are housed in a generally cylindrical housing 50 bounded on the ends by sidewalls 51. The housing has a diameter that is slightly larger than the outside diameter of the hammer segments 30. The housing carries a first slot 80 positioned in a first quadrant (upper right-hand quadrant) of the housing. The slot 80 extends longitudinally across the housing and is coextensive with the length of the rotor. A breaker bar assembly 79 is mounted over and is also coextensive with the slot 80. A feed roll assembly 85 is mounted in a conventional manner outwardly from the slot 80 and breaker bar assembly 79.

A breaker bar mount 84 is positioned exterior of the housing 50 and has a portion that extends into the downstream side of the slot 80. An L-shaped breaker bar 82 is adjustably mounted on the breaker bar mount 84. The breaker bar 82 has one arm 82*a* that extends radially inwardly into the slot and another arm 82*b* that extends over a shoulder 84*a* of the breaker bar mount 84. The breaker bar arm 82*b* is spaced from the shoulder 84*a* by spacers 56 used to adjust the gap between the hammer tips and the breaker bar. The leading edge 57 of the arm 82*a* of the breaker bar is positioned at a location slightly inwardly from the inner wall of the housing 50 and is also spaced slightly outwardly from the leading edge tips 36*a* of the hammer blades 36. As the rotor rotates in the counter-clockwise direction as indicated by arrow 60 in FIG. 2, the hammer tips 36*a* pass in close proximity to the leading edge 57 of the breaker bar arm 82*b*.

A pair of feed rolls 86 and 88, forming part of the feed roll assembly 85 are mounted in a conventional manner outwardly from the slot 80. The feed rolls 86 and 88 are driven in a conventional manner via a drive gear and motor. The feed rolls 86 and 88 are oriented longitudinally over the slot so that the nip of the feed rolls is positioned directly above the slot opening 78 and leading edge 57 of the breaker bar arm 82*b*. A pulp sheet 66 is fed between the feed rolls 86 and 88 into the slot 80 immediately upstream from the leading edge 57 of the breaker bar 82. A guide member 90, forming part of the breaker bar assembly, extends longitudinally along the slot 80 upstream from the breaker bar 82. The guide member 90 is attached to the exterior of the housing 50 in a conventional manner and has a lower sloped surface 72 that is sloped radially inwardly from the inner wall of the housing and in a downstream direction. (This guide member is described in detail in prior U.S. Pat. No. 5,560,553, assigned to Weyerhaeuser Company.). The forward edge 90*a* of the guide member 90 terminates a short distance upstream from and radially outwardly from the leading edge 57 of the breaker bar 82. The pulp sheet 66 is fed between breaker bar 82 and the forward edge 90*a* of the guide member 90. The guide member 90 and its sloped inner surface 72 are provided to prevent fibers from bunching up ahead of the leading edge 57 of the breaker bar 82 by deflecting the opened fibers downwardly.

A pair of guide bars 74 and 75 are mounted on the breaker bar assembly 79. The bars are positioned on each side of the pulp sheet 66 and extend inwardly and toward each other from below respective feed rolls 86 and 88 to a location adjacent the breaker bar 82 and guide member 90. The guide bars are mounted on mounting flanges 76 and 77, in turn fastened by conventional fasteners to the top of the breaker bar mount 84 and guide member 90. The guide bars 74 and 75 serve to ensure that the pulp sheet 66 is fed to the gap 78 between the breaker bar 82 and the guide member 70.

Returning to FIG. 2, in the preferred embodiment, a second slot 46 is provided along with a second breaker bar assembly 47, which includes second breaker bar 54, second breaker bar mounting bar 52 and second guide member 70. A second set 48 of feed rolls 62 and 64 are provided to supply a second sheet of pulp (not shown in FIG. 2) through the slot 46 and into the hammermill. The second feed roll assembly 48 of feed rolls and the breaker bar assembly 47 are positioned in a quadrant downstream from the first quadrant (upper left hand quadrant) where the first breaker bar assembly 79 is situated. Preferably, the first and second slots 80 and 46 are positioned so that the angle the pulp sheets make relative to a radius of the rotor as they are fed through the slots to the breaker bar assemblies is less than 45 degrees, is preferably less than. 25 degrees, and is most preferably about 22 degrees.

Still referring to FIG. 2, air is fed into the hammermill through an inlet conduit 100. The inlet conduit feeds into an air inlet 102, which has an opening extending longitudinally along the entire length of the housing 50. The air inlet 102 spans the entire distance of the rotor tips. The air inlet 102 is oriented so as to introduce air into the interior of the housing 50 tangentially along the inner surface of the housing 50. This aids in circulation of the singulated fibers through the hammermill to an outlet 110 located in the fourth quadrant of the hammermill. The air outlet conduit 110 has an opening 112 that is oriented tangentially to the hammermill housing and that extends longitudinally across the entire length of the housing 50, coextensive with the lateral extent of the air inlet opening 102. Air and singulated fibers are thus extracted from the hammermill through the opening 112 into the outlet conduit 110 by a product conveying fan(not shown). It is preferred that the air inlet 102 be positioned at a location less than 90 degrees downstream from the second feed slot 46. It is also preferred that the outlet conduit 110 be positioned at an angle from the air inlet, and preferably at a location on the order of 90 degrees and preferably from 90 degrees to 180 degrees downstream from the air inlet.

Figure 6:
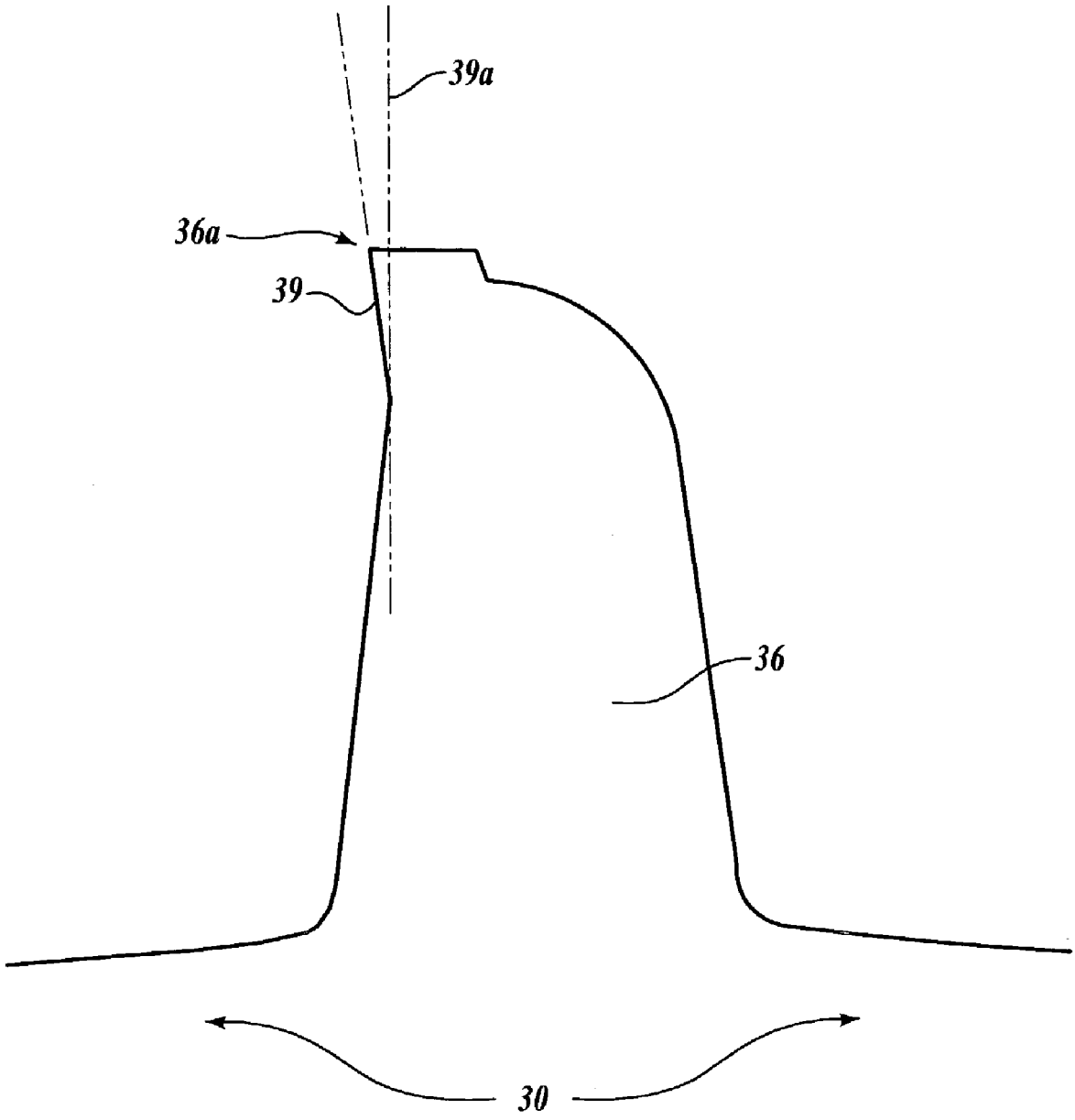
FIG. 6 is an enlarged elevation view of one hammer tip showing the angle the leading edge thereof makes with the radius of the rotor.

Referring to FIG. 6, a single hammer blade 36 is shown so that its leading edge 39 can clearly be seen. The leading edge 39 extends inwardly from the hammer tip 36*a*. The leading edge preferably defines an angle with a radius 39*a* of the rotor of from −4 to 10 degrees, and preferably from 4 to 6 degrees, where the positive angle extends in the direction of rotation of the rotor.

Figure 7:
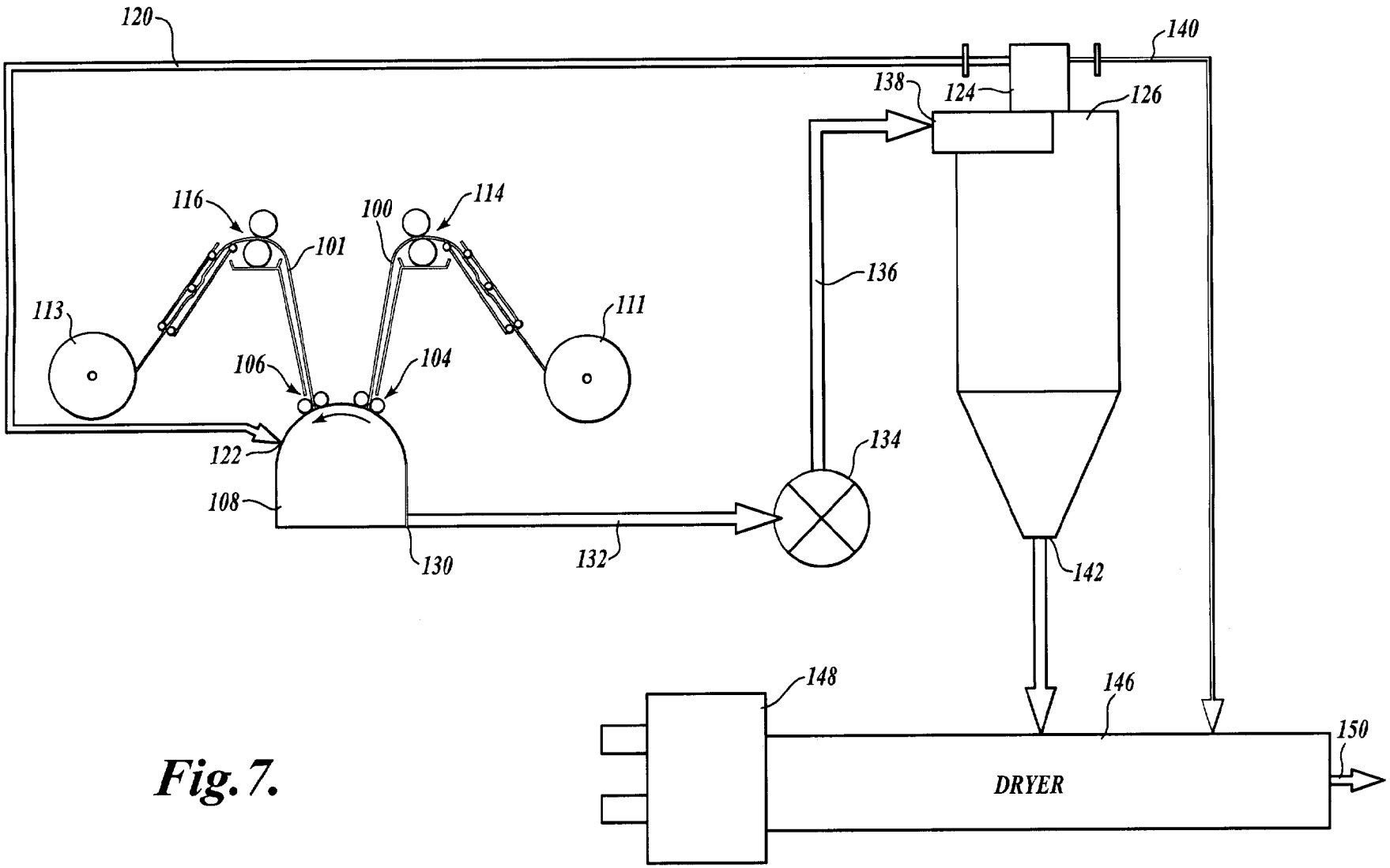
FIG. 7 is a schematic diagram of a novel process for singulating cellulose fibers from a pulp sheet.

Referring now to FIG. 7, two sheets 100 and 101 of wet pulp are fed through feed roll assemblies 104 and 106 respectively into first and second slots in a hammermill 108. Sheets 100 and 101 are taken from stock rolls 111 and 113 and are fed respectively through impregnation units 114 and 116. These impregnation units comprise a pair of counter-rotating rolls, which apply pressure to the pulp sheet with a chemical impregnating solution such as a crosslinking agent, that may be applied in a conventional manner, but is preferably applied in the manner described in conjunction with FIGS. 8 and 9 below. The solution is applied to the pulp sheets taken from the stock rolls 111 and 113. In this particular embodiment, the impregnating solution comprises a crosslinking agent for the cellulose fiber. The crosslinking agent is in an aqueous solution. When the fibers and crosslinker are heated, in a downstream portion of the process, intrafiber crosslinking takes place to form twisted, kinked and, curled bulky fibers.

Air is fed from a conduit 120 into air inlet 122 on hammermill 108. The conduit 120 receives air from the exhaust 124 of an air-fiber separator 126. In this embodiment, the air-fiber separator 126 preferably comprises a cyclone. Air and fiber are extracted from an exit 130 from the hammermill 108. The air and fiber are drawn from the hammermill via conduit 132 by a fan unit 134. The exhaust from the fan enters conduit 136, which in turn is fed tangentially into the upper portion 138 of the cyclone 126. As with the preferred embodiment of the hammermill described above, the air inlet 122 is positioned downstream of the infeed slots below feed roll assemblies 104 and 106. The exit 130 is preferably positioned from 90 to 180 degrees downstream from the inlet 122.

The fiber is separated from the air at the bottom of the cyclone 126 in a conventional manner. The air spirals upwardly into the exhaust 124 where it returns to conduit 120. A bleed conduit 140 is also coupled to the exhaust unit. The fiber drops from the outlet 142 of the cyclone 126 and is fed to a dryer 146. The dryer is supplied with hot air from a burner unit 148. The bypass conduit 140 is also fed to the dryer 146. Dried singulated fibers are taken from the dryer outlet 150 and further processed in the remaining system.

In this preferred embodiment, the pulp sheets 100 and 101 are fed into the hammermill at a sheet feet rate of from 7.6 to 91.5 meters per minute, more preferably from 22.9 to 48.8 meters per minute, and most preferably at about 30.5 meters per minute. The pulp sheets are impregnated in the impregnating stations 114 and 116 to a consistency of about 50% to 80%, more preferably from 63% to 73%, and most preferably about 68% in the hammermill 108. The hammer tips are rotating at a speed of from 3658 to 6706 meters per minute, more preferably from 4572 to 5791 meters per minute, and most preferably at about 5486 meters per minute.

Air is fed to the hammermill in an air to fiber weight ratio of about 2 to about 8 grams of air per gram of wet fiber, more preferably from 3 to 6 grams of air per pound of wet fiber, and most preferably about 4 grams of air per gram of wet fiber. The fan is preferably of the type that has a fiber opening wheel. The tip speed of the fan is preferably about 4267 to 6705 meters per minute, more preferably from about 5182 to 6096 meters per minute, and most preferably about 5791 meters per minute. The conduits 120, 132 and 136 are sized to achieve an air flow velocity of 1829 to 3048 meters per minute. It is preferred that the volumetric air flow into the hammermill be in the range of from 225 to 425 cubic meters per minute, preferably from 270 to 382 cubic meters per minute, and most preferably about 326 cubic meters per minute. The cyclone is designed to provide as high velocity as possible while maintaining efficiency in removing fiber from the air and discharging it to the dryer stage.

Figure 8:
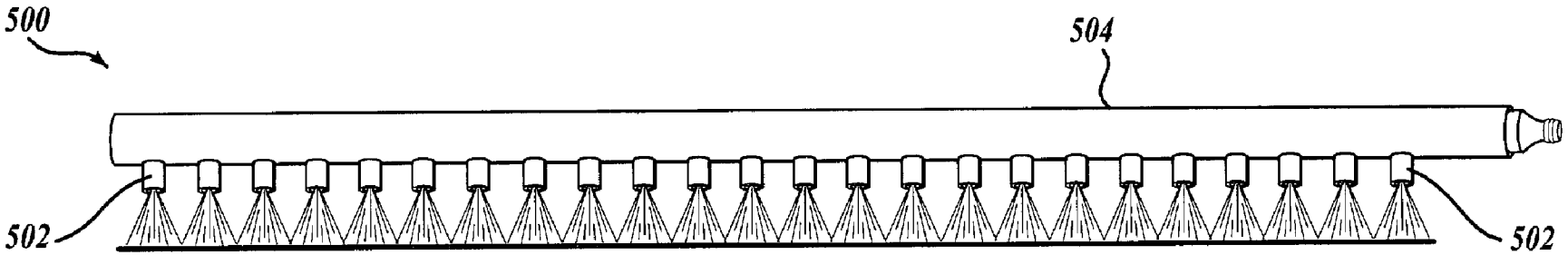
FIG. 8 is a perspective view of a fluid dispenser useful in the present invention.
Figure 9:
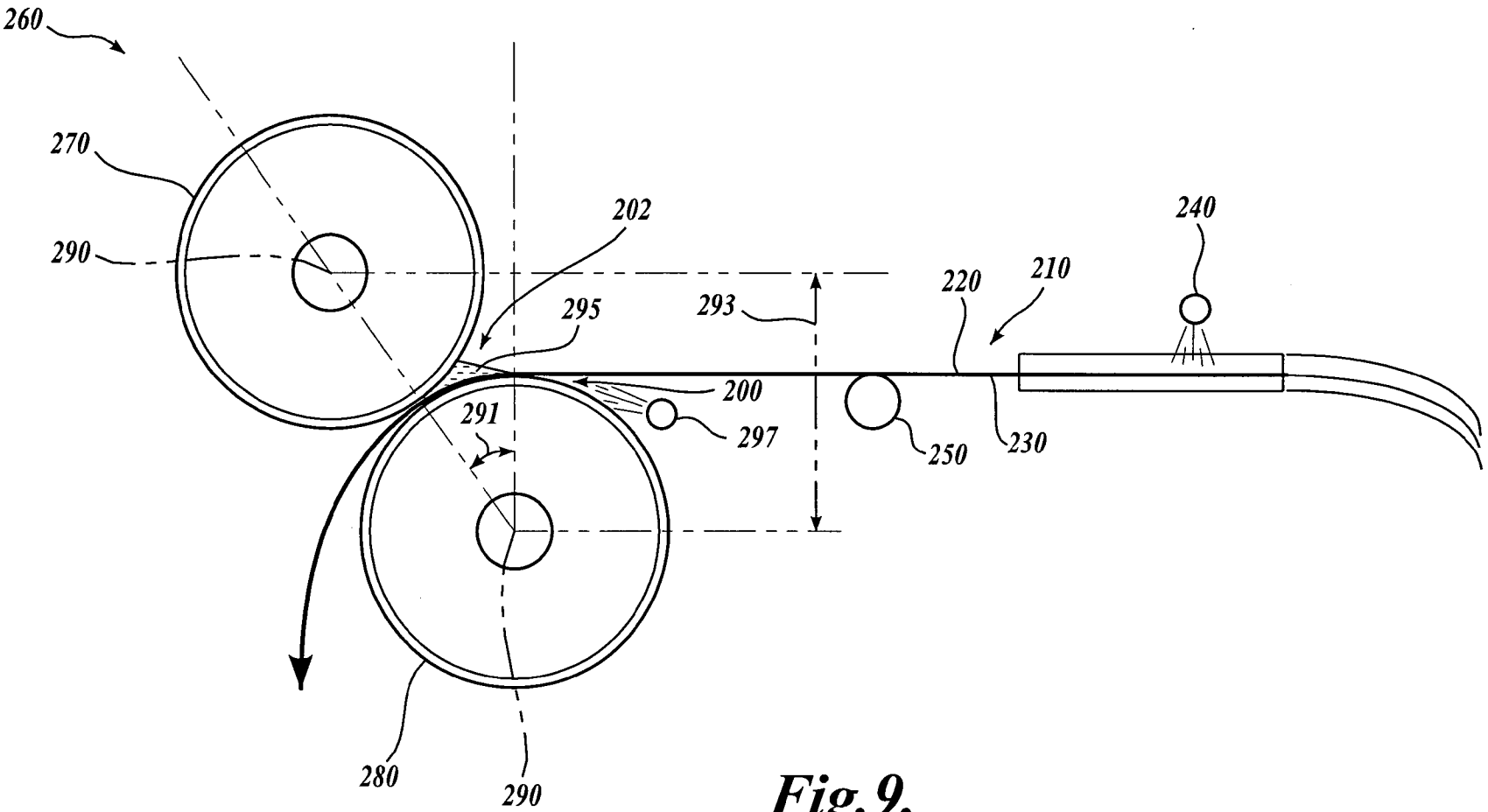
FIG. 9 is a schematic illustration of the general arrangement of a horizontal offset press useful in the present invention.

A preferred method for applying crosslinking agent to the cellulose fibers prior to introduction to the hammermill in accordance with the present invention is shown in FIGS. 8 and 9. Referring to FIG. 9, a sheet of cellulose fibers 210 to which crosslinking agent is applied in accordance with the present invention includes a first side 220 and an opposing side 230. In the illustrated embodiment, first side 220 is the upper side and second side 230 is the under side. Sheet 210 can be provided from a conventional roll of cellulose fibers. Sheet 210 of cellulose fibers passes a fluid dispenser 240 located upstream about 0.1 to 2.0 meters, from the nip 202 formed between the press and first side 220. The distance that fluid dispenser 240 is positioned from the nip between the press and first side 220 is selected taking into consideration, the type of fluff pulp sheet, the speed of the sheet of cellulose fibers 210, the amount of crosslinking agent to be applied to the sheet, the amount of crosslinking agent that the fluid dispenser can apply to the sheet, and the crosslinking agent retention time prior to pressing. For example, as the speed of the sheet increases, or the amount of crosslinking agent to be applied to the sheet increases, the distance between the fluid dispenser and the nip will increase. As the amount of crosslinking agent to be applied to the sheet increases, the distance between the nip and the fluid dispenser will vary depending on the type of crosslinking agent, the solution strength, the sheet speed, and the acquisition rate of the fluff pulp sheet. Optimization of these variables depend on factors such as type of fluff pulp sheet, crosslinking agent acquisition rate of pulp sheet, amount of crosslinking agent on the fiber desired, and the amount of FAQ wet bulk desired. The optimum amount of crosslinking agent applied to the fiber is determined by the fiber singulation and the FAQ wet bulk desired. This can be impacted by the type of crosslinking agent solution, the crosslinking agent solution strength, the amount of crosslinking agent applied by the distribution headers, the press loading and the overall singulation of the fibers. Optimization of these variables may result in an offset press pond just upstream of the press to assure complete crosslinking agent penetration throughout the fluff pulp sheet. The crosslinking agent is applied at a rate that is relative to the sheet speed, keeping the same amount of agent on the sheet at varying sheet speed.

The location of fluid dispenser 240 should be chosen so that time is provided for the crosslinking agent applied by fluid dispenser 240 to absorb into sheet 210 and expel air in the sheet before the second header applies chemistry to the under side 230. Absorption of the crosslinking agent into sheet 210 is evidenced by wet then dry line across the sheet before the sheet reaches a pond formed in the nip between roll 270 and first side 220. The pond is a volume of crosslinking agent that is squeezed from the sheet as it enters the press. The pond size and length is impacted by the amount of crosslinking chemistry applied to the sheet, the sheet speed, and the distance the headers are from the offset press nip.

Fluid dispenser 240 dispenses the crosslinking agent onto the first side 220 of sheet 210 of cellulose fibers. The design of the dispenser 240 is such that it applies the crosslinking agent uniformly across the width of the first side 220 of sheet 210. The selection of the size of the curtain slot, nozzles or orifices in the fluid dispenser along with their spacing is chosen to achieve such uniform distribution. In addition, the fluid dispenser is designed to provide the desired amount of crosslinking agent to the moving sheet 210. One type of useful fluid dispenser is a curtain header, the details of which are described below more thoroughly. Downstream from fluid dispenser 240 positioned in contact with the underside of sheet 210 is a guide roll 250 which serves to support and spread the moving sheet 210. Sheet 210 with its first side 220 treated with crosslinking chemicals is delivered to a press 260.

In the embodiment illustrated in FIG. 9, press 260 is a horizontal offset press that includes a first roll 270 and a second roll 280. Each roll 270 and 280 includes an axis of rotation 290. The rolls are of a conventional design and may include nitrile rubber covers. The axis of rotation 290 of roll 270 is offset both horizontally and vertically from the axis of rotation 290 of roll 280. An angle 291 is defined by a vertical line drawn through the axis of rotation of one roll and a line connecting the axis of rotation of the two rolls. Angle 291 may range from about 5 to about 30 degrees. The axes of rotation 290 of roll 270 and 280 are spaced apart in the vertical direction a distance 293. The distance 293 is less than the sum of the radiuses of roll 270 and roll 280 including the white nitrile rubber covers. Likewise, the distance that the axes of rotation are displaced horizontally from each other is less than the sum of the radiuses of the rolls. The size of angle 291 and the magnitude of vertical and horizontal offset between the rolls can vary and are selected so that a small reservoir 295 just upstream of the contact point between the outer circumferences of roll 270 and roll 280 is provided. By reservoir, it is meant that a location is provided at the contact point between the outer circumferences of roll 270 and roll 280 where fluid may accumulate.

Second side 230 of sheet 210 contacts the circumference of roll 280 at nip 200. First side 220 of sheet 210 contacts the outer circumference of roll 270 at nip 202 downstream from nip 200. In accordance with methods of the present invention, due to a combination of the load applied by press 260 and the amount of crosslinking agent applied by fluid dispenser 240, a pond of crosslinking agent forms in reservoir 295. Without being bound by theory, it is believed that the presence of this pond of crosslinking agent in reservoir 295 evidences the high loading level of crosslinking agent and uniform distribution of crosslinking agent within sheet 210, that is achievable with the methods and systems of the present invention. When a pond is absent from reservoir 295, the desirable high loading level of crosslinking agent and uniform distribution of the agent within a sheet of cellulose fibers may not be achieved in accordance with the methods and systems of the present invention. As sheet 210 leaves horizontal press 260, it is delivered to further unit operations for further processing.

In a particular embodiment, second side 230 of sheet 210 is contacted with crosslinking agent supplied by a second fluid dispenser 297 positioned downstream from fluid dispenser 240 and upstream of press 260. Fluid dispenser 297 directs crosslinking agent either on the sheet or into the nip 200 where the second side 260, of sheet 210 contacts the surface of roll 280. Directing crosslinking agent into nip 200 is to be distinguished from application of crosslinking agents onto the surface of roll 280 or application directly onto second side 230, 30' of sheet 210 prior to nip 200.

When crosslinking agent is applied to side 230 of sheet 210 a puddle of crosslinking fluid forms in the nip between roll 280 and side 230. A puddle is a volume of crosslinking agent that forms at the nip between roll 280 and side 230 as a result of the pressure applied to sheet 210 at the nip and the amount of crosslinking agent being applied to the fluff pulp sheet. Without being bound by theory, for the embodiment employing a horizontal press with offset rolls, the offset both radially and vertically between rolls 270 and 280 are chosen so that the portion of sheet 210 covered by the pond formed at nip 202 between roll 270 and upper side 220 of sheet 210 is not coextensive with the portion of sheet 210 covered by the puddle of crosslinking agent formed in the nip between roll 280 and side 230. With this configuration, gas contained within the sheet is purged with the agent application or is able to escape out a side of the sheet opposite the respective pond or puddle, rather than being trapped in the sheet. When the pond and puddle cover the same portion of sheet 210 on opposing sides, gas can be trapped in sheet 210. It is believed that by allowing gas present in the sheet to escape, the likelihood of total impregnation of the sheet is enhanced and delamination of the sheet as it exits the press is reduced.

In order to provide satisfactory loading on sheet 210 after crosslinking chemical has been applied thereto, the press is capable of applying a load of up to four hundred pounds per square inch.

Fluid dispensers 240, and 297 can take numerous forms such as rollers or sprayers and more applicators than these two described herein may be used. Referring to FIG. 8, a particular embodiment of a fluid dispenser is a curtain shower 500 designed to deliver the crosslinking agent through a number of nozzles 502 equally spaced along the length of a tubular header 504. The size and spacing of the spray nozzles is determined by the type of crosslinking agent, solution strength, and the amount of crosslinking agent that is to be applied per linear foot of the sheet of cellulose fibers. As discussed above, the size and spacing is chosen so that the curtain header applies the crosslinking agent across the sheet as it passes by the curtain header. Uniform application of the crosslinking agent to the surface of a sheet is evidenced by the absence of any dry lines or overly wet lines forming on the sheet immediately after application of the crosslinking agent. For sheet speeds ranging from about 7.62 to about 61 meters per minute, the curtain header should be capable of applying crosslinking agent in a manner as to achieve the complete sheet cover and penetration. As an alternative to nozzles, orifices may be formed in tubular header 504. Exemplary nozzles include VeeJet, FloodJet, WashJet, or UniJet nozzles by Spraying Systems Company, Wheaton, Ill. 60189.

Preferably, about 60 to 85 percent of the crosslinking agent to be applied in total to the sheet of cellulose fibers is applied by the fluid dispenser to the top surface 220 of the sheet and the remaining portion is applied using the second fluid dispenser 297. The amount of crosslinking agent to be applied by the respective dispensers should take into consideration the size of the pond or puddle that forms in the respective nips. Additional headers may be used to achieve the crosslinking agent acquisition and/or to apply varying types of crosslinking agent to the pulp sheet.

The total amount of crosslinking agent that can be added to the sheet of cellulose fibers is determined in part based on the desired consistency of the sheet after the crosslinking agent has been applied. Exemplary consistencies range from about 50% to about 80% with the preferred consistency being about 68% to achieve optimum application rate, singulation of fibers and FAQ wet bulk. The systems and method of the present invention allow loading of crosslinking agent on pulp in the range of about 1% to about 30% crosslinking agent based on dry pulp weight, but preferably about 10%. In order to provide desirably high bulk and fluid acquisition quality properties, the amount of crosslinking agent applied to the sheet of cellulose fibers ranges from about 5% to 40% weight. The range of FAQ wet bulk achieved by the present invention range from about 8 to about 30 cc/g but preferably about 16-22 cc/g.

Cellulose fibers singulated in accordance with the foregoing process are found to have a substantially lower knot or unopened fiber content than fiber singulated by conventional methods, including processing by a fluffer and additional fan before being introduced into a drier. Debonded, crosslinked fibers processed by the present invention have a Pulmac wet knot content less than 0.5%, more preferably less than 0.1%, and most preferably less than 0.05%. Similarly, debonded crosslinked fibers singulated by the present invention have a 2× sonic knot content less than 2%, and preferably 1%.

Crosslinked pulp fiber that is made from non-debonded pulp and processed in accordance with the present invention have a 2× sonic knot content of less than 14%, and preferably less than 12% and a Pulmac wet knot content of less than 4% and preferably less than 2%.

EXAMPLES

The following examples are intended to be illustrative of the present invention and are not intended in any way to delimit the scope of coverage provided herein.

In the examples below, "2× Sonic knots" were tested by the following method for classifying dry crosslinked fluffed pulp into four layered fractions based on screen mesh size. The first fraction is the layer knots and is defined as that material that is captured by a No. 5 mesh screen. The second fraction is the intermediate knots and is defined as the material captured by a No. 8 mesh screen. The third fraction is the smaller knots and is defined as the material captured by a No. 12 mesh screen. The fourth fraction is the accepts or the singulated fibers and is defined as that material that passes through No. 5, 8, and 12 mesh screens but is captured by a No. 60 mesh screen. The separation is accomplished by sound waves generated by a speaker that are imposed upon a pre-weighed sample of fluff pulp placed on the first layered No. 5 mesh screen that is near the top of a separation column where the speaker sits at the very top. After a set period of time, each fraction from the No. 5, 8 and 12 screens is removed from the separation column and is added back to the No. 5 screen for the second pass through the sonic test. After the set period of time, each fraction from the No. 5, 8 and 12 screens is removed from the separation column and weighed to obtain the weight fraction of knots, accepts/singulated fiber and fines.

The Pulmac wet knots are measured by placing a singulated pulp fibers in an aqueous slurry and then filtering the slurry through a rotational plate with multiple slots measuring 0.010 inch wide. The material remaining on the screen is flushed from the test unit and measured on a dry weight basis to determine the percentage of Pulmac wet knots in the crosslinked fiber.

Example 1

A conventional debonded softwood pulp sheet is wetted with a crosslinking agent in a conventional manner and fed into a conventional hammermill at a rate of 30.5 meters per minute. The wetted sheet has a consistency of about 62%. In this hammermill, the air is introduced downstream of the feed slots near the horizontal plane at the point of discharge. The hammer tip speed of the conventional hammermill is approximately 2896 meters per minute. Volumetric in-flow air to the hammermill is about 127.5 cubic meters per minute, and the out-flow velocity is about 1463 meters per minute. The hammermill fiber is separated from the air stream in a cyclone. A conventional air moving fan is employed downstream of the hammermill and has tip speeds of about 4267 meters per minute. The material is then sent through a conventional fluffer for further fiber opening followed by a second product fan where it is then introduced into a conventional dryer. The product is tested and found to have Pulmac wet knot content on the order of 0.6 to 0.8% and sonic knots on the order of 4 to 6%.

Example 2

A debonded softwood pulp sheet is wetted with a crosslinking agent with the apparatus described above in conjunction with FIGS. 8 and 9, and run through a hammermill having a chevron rotor of the type disclosed herein. The pulp is fed at a sheet speed of about 30.5 meters per minute and is first wetted to a consistency of about 68%. The hammer tip speed is about 5486 meters per minute and the air to fiber ratio is about 4 grams of air per gram of wet fiber. The fan is operated at a tip speed of about 5791 meters per minute. The conduits are sized so as to achieve a flow velocity ranging from 1829 to 3048 meters per minute. The material is taken directly from the cyclone and is run through a first stage dryer without introducing it into a fluffer or a second product fan. The product is tested and found to have a Pulmac wet knot content of less than about 0.05% and sonic knots ranging from 1% to 2%.

While the preferred embodiment of the invention has been illustrated and described, it will be appreciated that various changes can be made therein without departing from the spirit and scope of the invention.

The embodiments of the invention in which an exclusive ptoperty or privilege is claimed are defined as follows:

1. A process for singulating cellulose fibers from a wet pulp sheet comprising:

feeding the pulp sheet to a hammermill, the pulp sheet being fed to the hammermill at a sheet feed speed of from 7.6 to 91.5 meters per minute, said hammermill having rotor tips, said rotor tip speed being from 3658 to 6706 meters per minute;

feeding an air stream to the hammermill at an air feed location downstream from the pulp feed location;

milling the pulp sheet in the hammermill to produce singulated fibers;

conveying the singulated fibers in an air stream from the hammermill at an outlet location oriented at an angle from said air feed location to an air fiber separator, said singulated fibers conveyed from said hammermill to said air fiber separator by a fan, said fan and conduits sized sufficiently to provide an air stream velocity of from 1829 to 3048 meters per minute; and separating said singulated fibers from the air stream.

2. The process of claim 1 wherein said sheet feed speed ranges from 22.9 to 45.7 meters per minute.

3. The process of claim 2 wherein said sheet feed speed is about 24.4 meters to 36.5 meters per minute.

4. The process of claim 1 wherein said hammer tip speed ranges from 4572 to 5791 meters per minute.

5. The process of claim 4 wherein said hammer tip speed is about 5486 meters per minute.

6. The process of claim 1 wherein the weight ratio of air fed to said hammermill to fiber fed to said hammermill ranges from 2 grams to 8 grams of air per gram of wet fiber.

7. The process of claim 6 wherein said air to fiber ratio is about 3 grams to 6 grams of air per gram of wet fiber.

8. The process of claim 1 wherein the volumetric air flow to the hammermill ranges from about 225 to about 400 cubic meters per minute.

9. The process of claim 8 wherein the volumetric air flow rate is about 270 to 382 cubic meters per minute.

10. The process of claim 1 wherein said hammermill comprises a plurality of hammers having hammer tips arranged in a W pattern, said W pattern having peaks as leading edges of the W pattern in the direction of rotation of said rotor.

11. The process of claim 1 further comprising:

opening said fibers downstream of said milling step by conveying said fiber with a fan operating at a fan tip speed ranging from 4267 to 6705 meters per minute.

* * * * *